US006701621B2

(12) United States Patent
Kain et al.

(10) Patent No.: US 6,701,621 B2
(45) Date of Patent: Mar. 9, 2004

(54) RELEASABLE DOUBLE LOCKING KNIFE

(76) Inventors: Charles L. Kain, 1736 E. Maynard Dr., Indianapolis, IN (US) 46227; Rohit C. Chopra, 330 Hannaford Dr., Roswell, GA (US) 30075

( * ) Notice: Subject to any disclaimer, the term of this patent is extended or adjusted under 35 U.S.C. 154(b) by 0 days.

(21) Appl. No.: 10/141,150

(22) Filed: May 8, 2002

(65) Prior Publication Data

US 2003/0208908 A1 Nov. 13, 2003

(51) Int. Cl.[7] ..... B26B 1/04
(52) U.S. Cl. ..... 30/160; 30/161
(58) Field of Search ..... 30/160, 161

(56) References Cited

U.S. PATENT DOCUMENTS

| | | | | |
|---|---|---|---|---|
| 1,454,665 | A | 5/1923 | Bobek | |
| 1,743,022 | A | 1/1930 | Carmen | |
| 4,040,081 | A | 8/1977 | Ninomiya et al. | |
| 4,347,665 | A | 9/1982 | Glesser | |
| 4,404,748 | A | 9/1983 | Wiethoff | |
| 4,451,982 | A | 6/1984 | Collins | |
| 4,502,221 | A | 3/1985 | Pittman | |
| 4,719,700 | A | 1/1988 | Taylor, Jr. | |
| 4,805,303 | A | 2/1989 | Gibbs | |
| 4,811,486 | A | 3/1989 | Cunningham | |
| 4,837,932 | A | 6/1989 | Elsener | |
| 4,974,323 | A | 12/1990 | Cassady | |
| 4,979,301 | A | 12/1990 | Walker | |
| 5,044,079 | A | 9/1991 | Gibbs | |
| 5,060,379 | A | 10/1991 | Neely | |
| 5,095,624 | A | 3/1992 | Ennis | |
| 5,111,581 | A | 5/1992 | Collins | |
| 5,293,690 | A | 3/1994 | Cassady | |
| 5,331,741 | A | 7/1994 | Taylor, Jr. | |
| 5,502,895 | A | 4/1996 | Lemaire | |
| 5,515,610 | A | 5/1996 | Levin et al. | |
| 5,537,750 | A | 7/1996 | Seber et al. | |
| 5,689,885 | A | 11/1997 | Walston | |
| 5,692,304 | A | 12/1997 | Campbell | |
| 5,737,841 | A | 4/1998 | McHenry et al. | |
| 5,755,035 | A | 5/1998 | Weatherly | |
| 5,802,722 | A | 9/1998 | Maxey et al. | |
| 5,822,866 | A | 10/1998 | Pardue | |
| 5,826,340 | A | 10/1998 | Hull | |
| 5,887,347 | A | 3/1999 | Gibbs | |
| 6,105,255 | A * | 8/2000 | Cheng | 30/161 |
| 6,145,202 | A | 11/2000 | Onion | |
| 6,434,831 | B2 * | 8/2002 | Chen | 30/161 |

* cited by examiner

*Primary Examiner*—Douglas D. Watts
(74) *Attorney, Agent, or Firm*—Bose McKinney & Evans LLP

(57) ABSTRACT

A releasable, double locking knife including a body having a cavity and a pair of opposed arms, each having a free end extending into the cavity, and a blade connected to the body for rotation between the closed position wherein the blade is disposed substantially within the cavity and an open position wherein the blade is disposed substantially outside the cavity. The opposed arms engage side surfaces of the blade when the blade is in the closed position to resist movement of the blade out of the closed position. The arms further engage stop surfaces on the blade when the blade is in the open position, thereby locking the blade in the open position. The blade further includes a release mechanism for moving the arms out of locking engagement with the blade to permit movement of the blade out of the open position.

23 Claims, 12 Drawing Sheets

10

RELEASABLE DOUBLE LOCKING KNIFE

FIELD OF INVENTION

The present invention relates generally to knives, and more particularly to folding hand knives that are moved between a locked, open position and a folded position using one hand.

BACKGROUND OF THE INVENTION

It is known to provide knives that fold to a closed position and open to an in-use position using one hand. Such knives, however, are configured to operate using either only the left hand or only the right hand. A left handed knife, for example, is not operable using the right hand. Moreover, conventional, one-handed folding knives provide mechanisms for locking the knife in the extended position that are relatively easy to overcome, thereby compromising safety.

SUMMARY OF THE INVENTION

The present invention provides a releasable, double locking knife that may be operated using either the left hand or the right hand. The knife includes a body and a blade pivotally connected to the body for movement between a closed position and an open position. The body includes a pair of moveable arms that are biased toward one another into a locking position wherein the arms engage a stop surface of the blade, thereby locking the blade in the open position. Additionally, the blade carries a release mechanism that is operated by the user with the left or right thumb. When the knife is in the open position, the release mechanism is moveable toward the pair of moveable arms, and includes a pair of cam surfaces that urge the arms out of engagement with the blade, thereby permitting the blade to be folded into the closed position.

The features and advantages of the present invention described above, as well as additional features and advantages, will be readily apparent to those skilled in the art upon reference to the following description and the accompanying drawings.

DETAILED DESCRIPTION OF EMBODIMENTS OF THE INVENTION

The embodiments described below are merely exemplary and are not intended to limit the invention to the precise forms disclosed. Instead, the embodiments were selected for description to enable one of ordinary skill in the art to practice the invention.

Figure 1:
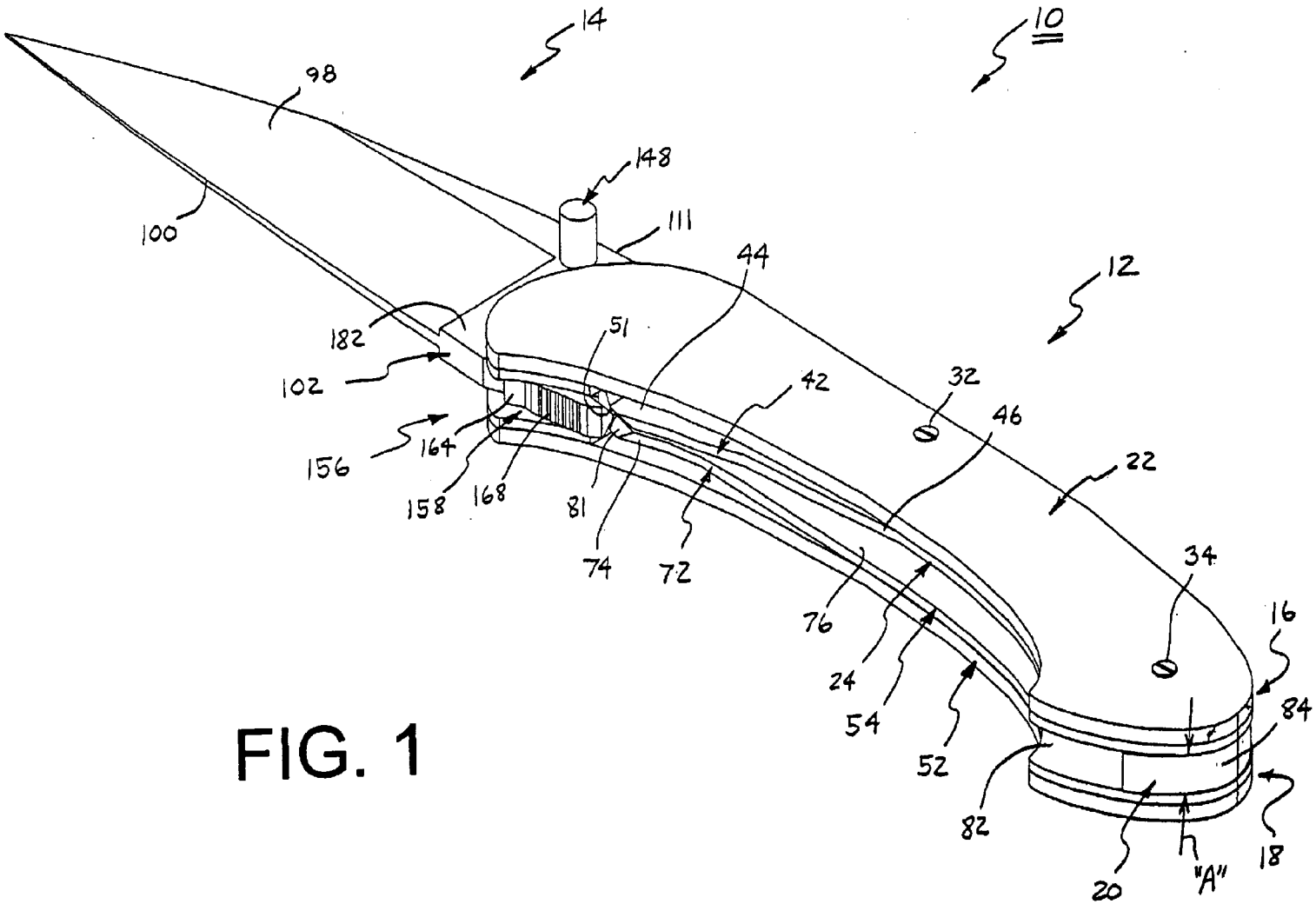
FIG. 1 is a perspective view of a knife according to one embodiment of the present invention.

Referring now to FIG. 1, a releasable, double locking knife according to one embodiment of the present invention is generally designated by number 10. Knife 10 generally includes a body 12 and a blade 14. Although this specification refers to blade 14 as a means for cutting material, it should be understood that the teachings of the present invention may be applied to a variety of different foldable tools, and is not limited to knives. For example, blade 14 may be replaced with a screw driver, a bottle opener, a cork screw, or any of a variety of other different types of tools. Body 12 generally includes a first side 16, second side 18, and a spacer 20 and may be formed in the shape of a handle having curved outlines as shown, or formed in any other shape for gripping when blade 14 is in the open position.

Figure 2:
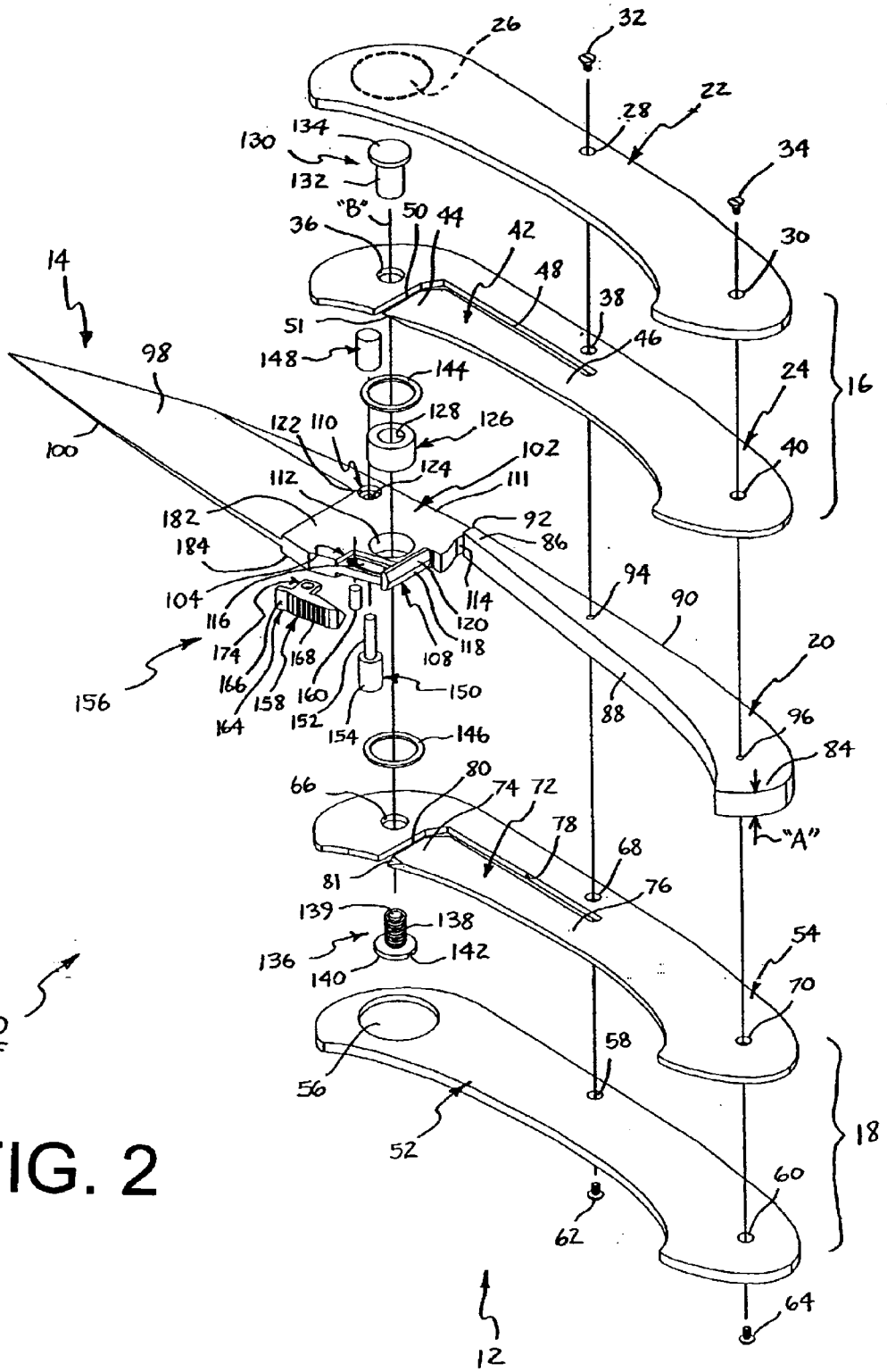
FIG. 2 is an exploded, perspective view of components of the knife shown in FIG. 1.

Referring now to FIG. 2, side 16 includes a scale 22 and a liner 24. Scale 22 includes a recessed area 26, and a pair of openings 28, 30 for receiving fasteners 32, 34 to connect side 16 to spacer 20. Liner 24 may be shaped as shown to have an outline that corresponds substantially to the outline of scale 22. Liner 24 includes a through hole 36 centered in a location adjacent one end of liner 24 that substantially corresponds to the center of recessed area 26 of scale 22 when liner 24 and scale 22 are connected together as will be further described below. Liner 24 further includes a pair of openings 38, 40 that similarly correspond to the locations of openings 28, 30 of scale 22 when liner 24 and scale 22 are connected together.

Liner 24 also includes a moveable arm, generally referred to by number 42. In one embodiment of the invention, arm 42 is integral with and formed as a part of liner 24. It should be understood, however, that arm 42 (and the opposed arm of side 18) may be separate from liner 24, but connected or otherwise coupled to liner 24 to operate in the manner described below. In the illustrated embodiment, arm 42 includes a first end 44 and a second end 46. Second end 46 depends from liner 24 while first end 44 (or free end of moveable arm 42) is moveable substantially into and out of a plane containing liner 24. Thus, in this embodiment, arm 42 may be formed by cutting a slot 48 into liner 24 as shown in the drawings. As will be described in greater detail in the description of the operation of knife 10, according to one embodiment of the present invention, arm 42 also includes an engagement surface 50 for cooperating with a portion of blade 14 to lock blade 14 in the open position, and a cam surface 51 for cooperating with a release mechanism of blade 14 to permit movement of blade 14 out of the open position.

As best shown in FIG. 1, arm 42 is bent or biased slightly downwardly (as viewed in the figure) relative to the plane containing liner 24. Thus, free end 44 and engagement surface 50 are disposed, when in a relaxed or locking position, out of the plane containing liner 24 away from scale 22. Liner 24 and arm 42 are formed, in one embodiment, of steel or other suitable material to provide strength and rigidity to body 12, but permit some flexibility of arm 42 such that free end 44 may be moved into and out of its relaxed position.

Side 18 is essentially a mirror image of side 16. Side 18, generally includes a scale 52 and a liner 54. Scale 52, like scale 22, includes a recessed area 56, and a pair of openings 58, 60 for receiving fasteners 62, 64. Liner 54, like liner 24, includes a through hole 66, and a pair of openings 68, 70 that are substantially aligned with recessed area 56, and openings 58, 60, respectively, when liner 54 is attached to scale 52. Liner 54 also includes a moveable arm 72 having a first end 74 (or free end) and a second end 76 that may depend from liner 54 in the manner described above with respect to arm 42. In this embodiment, arm 72 is formed from the material forming liner 54 by providing a slot 78 as shown in the figure. Like arm 42, arm 72 includes an engagement surface 80 and a cam surface 81. Free end 74 of arm 72 is disposed, in its relaxed or locking position, out of a plane containing liner 54 and spaced apart from scale 52. Accordingly, as will be further described below, when knife 10 is assembled, moveable arms 42, 72 are biased toward one another to lock blade 14 in the open position, but may be flexed apart from one another to release blade 14 from the open position.

Spacer 20 of body 12 has a thickness "A" that substantially corresponds to the width of a cavity 82 (FIG. 1) formed within body 12 for receiving blade 14 when in the closed position. Spacer 20 includes a first end 84, a second end 86, an inner side 88, and an outer side 90. First end 84 and outer side 90 are curved to substantially correspond to the shape of the outlines of scales 22, 52, and liners 24, 54 such that when all of the components are connected together as shown in FIG. 1, they form a substantially smooth profile. Inner side 88 tapers toward side 90 with distance from end 84 as shown in the figure to provide space for blade 14 when folded into the closed position and received by cavity 82. End 86 includes an abutment surface 92 that cooperates with a surface of blade 14 to limit the pivotal movement of blade 14 when blade 14 is moved to the open position as will be further described below. Finally, spacer 20 includes two threaded openings 94, 96 facing liner 24 and two threaded openings (not shown) facing liner 54. Openings 94, 96 are located to align with openings 28, 30 of scale 22 and openings 38, 40 of liner 24, respectively. Scale 22 and liner 24 are connected to spacer 20 by inserting fasteners 32, 34 through the appropriate openings in scale 22 and liner 24, and threading fasteners 32, 34 into threaded openings 94, 96 of spacer 20. The other threaded openings (not shown) of spacer 20 facing liner 54 are similarly located to receive fasteners 62, 64 when fasteners 62, 64 are inserted through the corresponding openings of scale 52 and liner 54 to connect scale 52 and liner 54 to spacer 20 in the manner described above.

Figure 3:
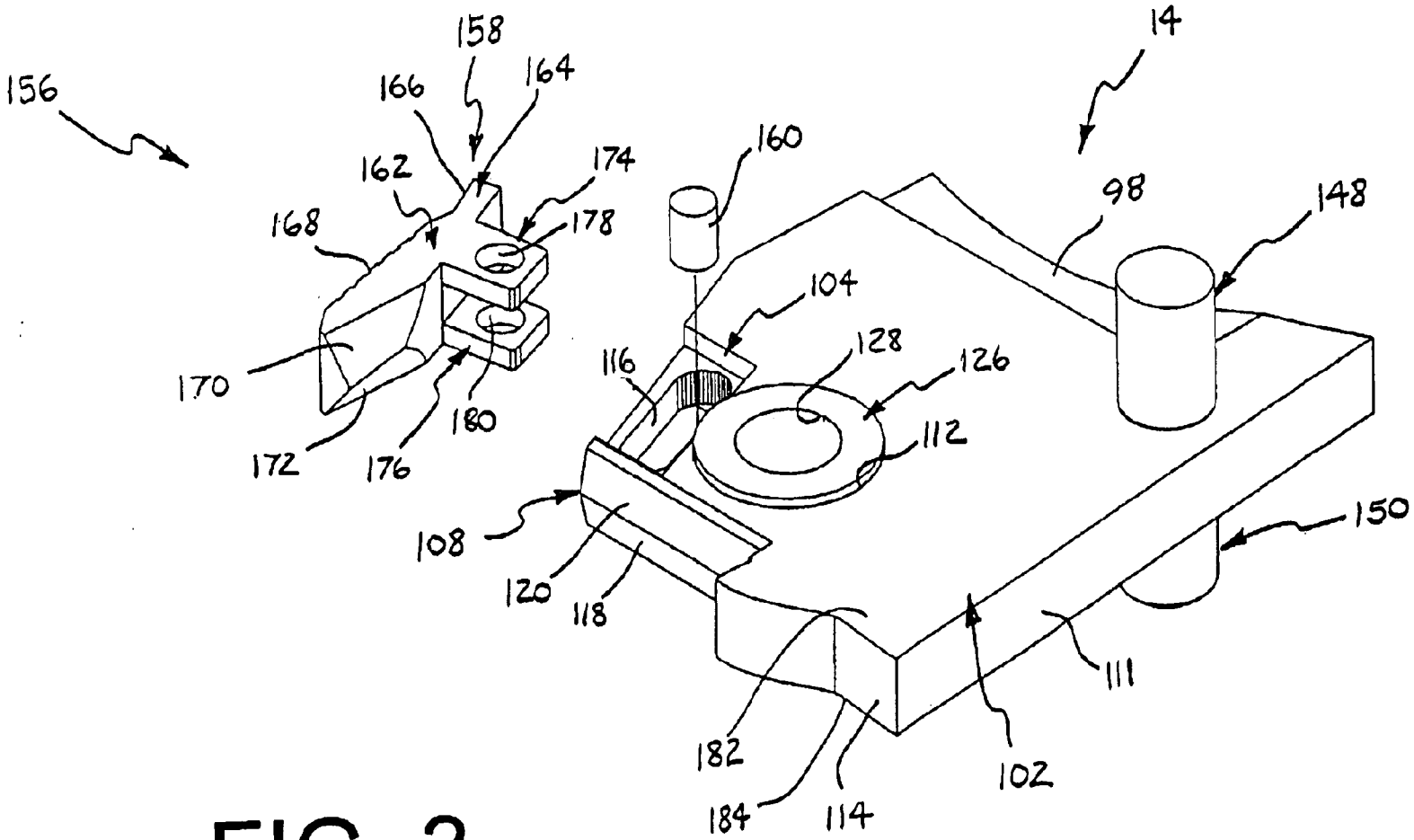
FIG. 3 is a partially fragmented, perspective view of a release mechanism according to one embodiment of the present invention.

Referring now to FIGS. 2 and 3, blade 14 generally includes a cutting portion 98 having a sharpened edge 100, and a base generally referred to by the number 102. Base 102 generally includes a first side surface 182, a second side surface 184, a recessed portion 104, a wedge 108, a thumb stud opening 110 (FIG. 1), a pivot opening 112, and an abutment surface 114. As shown, recessed portion 104 is recessed into both sides 182, 184 of base 102 to form a reduced thickness area, and includes a slot 116 for cooperating with a release mechanism 156 to release the knife 10 from its locked, open position. Wedge 108 includes a pair of stop surfaces 118, 120 for cooperating with engagement surfaces 80, 50 of arms 72, 42, respectively, to lock blade 14 in the open position, as will be further described below. It should be noted that stop surfaces 118, 120 form a substantially obtuse angle relative to one another that substantially corresponds to an obtuse angle formed by engagement surfaces 80, 50 when arms 72, 42 are in the relaxed position and biased fully toward one another. Thumb stud opening 110 is situated adjacent edge 111 of base 102, and includes a recess 122 into surface 182, a through hole 124, and a similar recess (not shown) into surface 184.

Pivot opening 112 is sized to receive a pivot bearing 126 which is substantially cylindrical and has a height that is slightly greater than the thickness of base 102 of blade 14. Pivot bearing 126 includes a central opening 128 that is sized to receive a pivot pin 130.

Pivot pin 130 includes a shaft 132 that has a diameter that is slightly smaller than the diameter of opening 128 such that bearing 126 can pivot about shaft 132. Pivot pin 130 also includes an enlarged diameter head 134. Shaft 132 of pivot pin 130 is internally threaded to receive the threads 138 of a pivot screw 136 having a threaded shaft 139 and an enlarged diameter head 140 with a slot 142 for screwing pivot screw 136 into shaft 132 using a screwdriver or similar tool. As will be further described below, a pair of spacers 144, 146, formed in the shape of thin washers having openings with a diameter that is larger than the outer diameter of pivot bearing 126, are positioned within body 12 to stabilize blade 14 and minimize side-to-side motion of blade 14 during use.

As also shown in FIG. 2, knife 10 further includes a first thumb stud 148 and a second thumb stud 150. First thumb stud 148 is substantially cylindrical in shape and has a threaded, internal opening (not shown). First thumb stud 148 has an outer diameter that substantially corresponds to the diameter of recess 122 such that first thumb stud 148 sits within recess 122. Second thumb stud 150 includes a threaded shaft 152 and a stud portion 154 having a diameter that substantially corresponds to the diameter of another recess (not shown), similar to recess 122, formed in surface 184 of base 102. Thumb studs 148, 150 are attached to base 102 of blade 14 by inserting shaft 152 of second thumb stud 150 through thumb stub opening 110 and threading shaft 152 into the threaded, internal opening (not shown) of first thumb stud 148. When shaft 152 of second thumb stud 150 is tightly threaded into the threaded, internal opening of first shaft 148, first thumb stud 148 is tightly drawn into recess 122 and lateral movement of thumb studs 148, 150 is prevented by through hole 124 and recess 122.

Finally, knife 10 further includes a release mechanism generally referred to by the number 156. As best shown in FIG. 3, release mechanism 156 generally includes an actuator 158 and a rod 160. Actuator 158 includes a body 162 with an end tab 164 having a stop surface 166, a ridged bearing surface 168, a pair of cam surfaces 170, 172 forming a wedge, and a pair of parallel tabs 174, 176. Tab 174 includes an opening 178 that is aligned with a similar opening 180 formed in tab 176. Release mechanism 156 is connected to base 102 of blade 14 by positioning actuator 158 such that parallel tabs 174, 176 fit within recessed portion 104. The distance between the facing surfaces of parallel tabs 174, 176 is slightly greater than the thickness of recessed portion 104 of base 102. Accordingly, tabs 174, 176 can move within recessed portion 104. Actuator 158 is coupled to base 102 by inserting rod 160 through opening 178 of tab 174, slot 116 of base 102, and opening 180 of tab 176. Rod 160 has an outer diameter that is slightly smaller than the width of slot 116 such that rod 160 is moveable along the length or axis of slot 116. Rod 160 may be press fit into openings 178, 180 or otherwise connected to tabs 174, 176. The path of travel of actuator 158 is substantially defined by slot 116 and the various surfaces of base 102 forming recessed portion 104. As will be further described below, actuator 158 is thereby moveable toward and away from arms 42, 72 along the axis of slot 116.

Referring back to FIG. 2, after release mechanism 156 and thumb studs 148, 150 are coupled to blade 14 in the manner described above, the overall assembly of knife 10 is accomplished by next inserting pivot bearing 126 into pivot opening 112 of base 102. Pivot bearing 126 is press fit into opening 112 and because pivot bearing 126 is slightly longer than the thickness of base 102 at pivot opening 112, the ends of pivot bearing 126 protrude slightly beyond side surfaces 182, 184 of base 102 as best shown in FIG. 3. The length of pivot bearing 126 is the same as thickness "A" of spacer 20. Spacer 144 is then placed on the protruding end of pivot bearing 126 and encircles pivot bearing 126. The thickness of spacer 144 is such that its outer surface (relative to base 102) is flush with the end surface of pivot bearing 126 when spacer 144 is placed onto pivot bearing 126.

Through hole 36 of liner 24 is then aligned with opening 128 of pivot bearing 126 and shaft 132 of pivot pin 130 is placed through through hole 36 and opening 128. The partially assembled knife may then be flipped over while holding pivot pin 130 in place. Spacer 146 is then placed over the protruding end of pivot bearing 126 and through hole 66 of liner 54 is aligned with shaft 132 of pivot pin 130. Threaded shaft 139 of pivot screw 136 is then inserted through through hole 66, opening 128, through hole 36, and threaded into the threaded, internal opening (not shown) of shaft 132. It should be understood by one skilled in the art that when pivot screw 136 is fully tightened into pivot pin 130, blade 14 may rotate about a rotation axis (designated by the letter "B") extending through pivot pin 130, through hole 36, spacer 144, pivot bearing 126, pivot opening 112, spacer 146, through hole 66 and pivot screw 136. Moreover, the length of shaft 132 of pivot pin 130 is such that its free end is flush with the lower surface of liner 54 (as viewed in FIG. 2) so that when pivot screw 136 is fully threaded into shaft 132, head 140 engages the free end of shaft 132. This prevents pivot rod 130 and pivot screw 136 from impeding rotation of blade 14 by compressing liners 24, 54 against spacers 144, 146 and base 102 or against pivot bearing 126. While blade 14 is not compressed between liners 24, 54, the length of shaft 132 of pivot pin 130 and the thickness of base 102, pivot bearing 126, and spacers 144, 146 are such that blade 14 is prevented from wobbling side-to-side relative to liners 24, 54.

Spacer 20 may then be positioned between liners 24, 54 such that the threaded openings 94, 96 align with openings 38, 40 of liner 24. Scale 22 may then be placed onto liner 24 such that head 134 of pivot pin 130 is received within recessed area 26 and openings 28, 30 align with openings 38, 40 of liner 24, respectively. Fasteners 32, 34 are used to connect scale 22 to liner 24 and spacer 20 as described above. It should be understood that more than two fasteners (and corresponding openings) may be provided, or a single fastener may be used to attach the above-described components together. Also, one or more such fasteners may extend from one of scales 22, 51, through spacer 20, and connect to the other of scales 22, 52.

The threaded openings (not shown) on the other side of spacer 20 are also aligned with openings 68, 70 of liner 54. Scale 52 may then be placed on liner 54 such that head 140 of pivot screw 136 is received in recessed area 56, and openings 58, 60 are aligned with openings 68, 70 of liner 54. Fasteners 62, 64 are used to connect scale 52 to liner 54 and spacer 20 in the manner described above.

Figure 4:
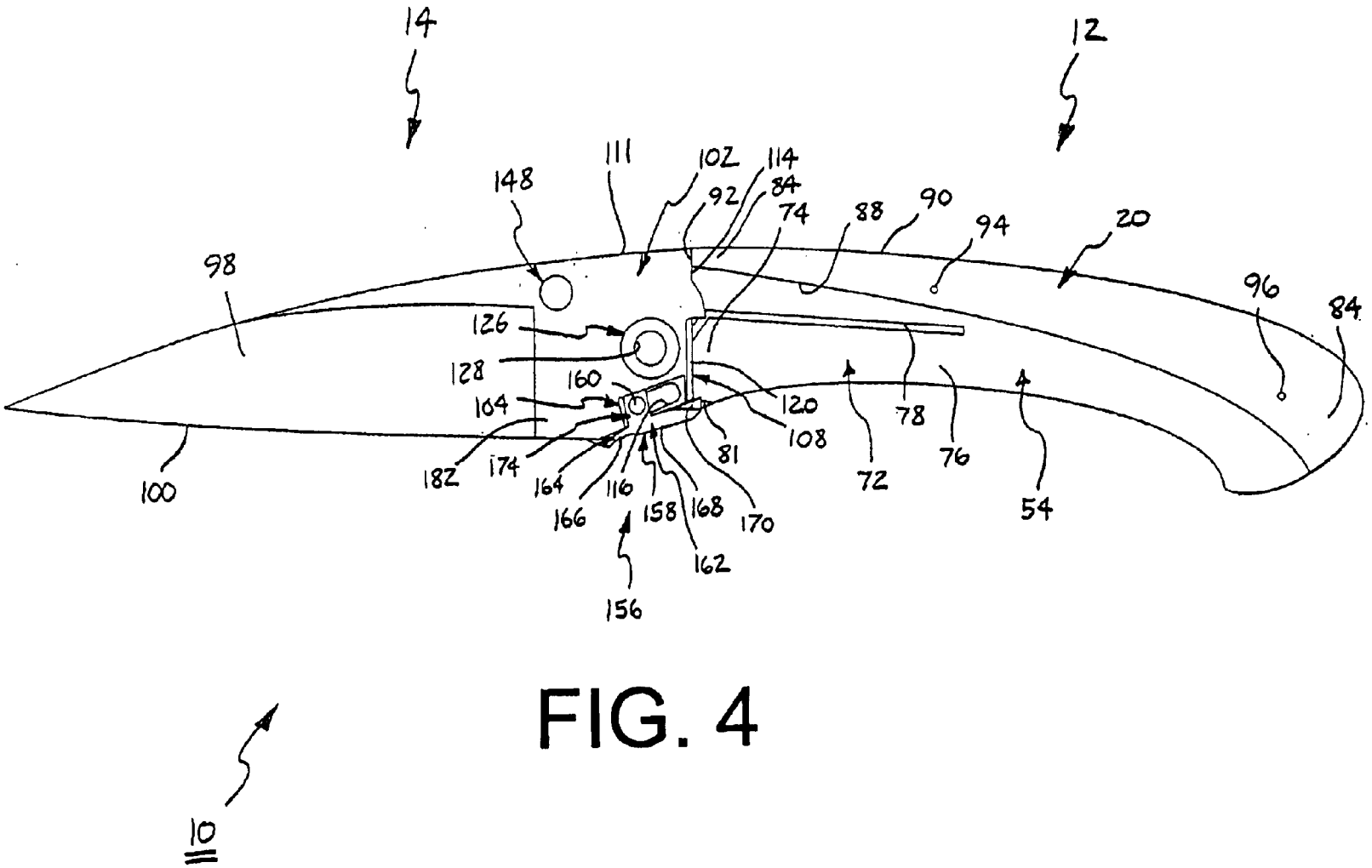
FIG. 4 is a side, elevational view of a knife according to the present invention in the open position with certain components removed for clarity.
Figure 5:
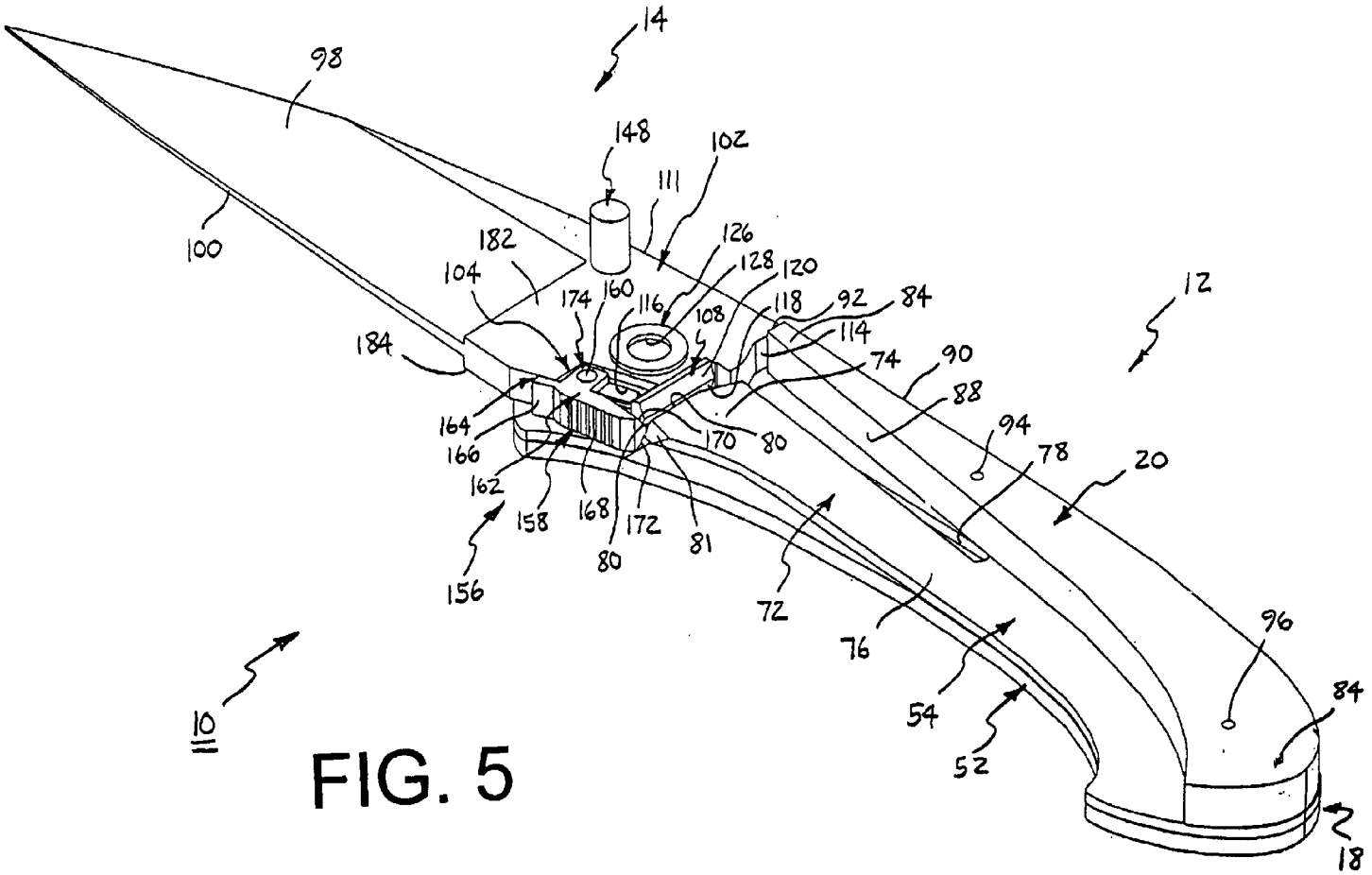
FIG. 5 is a perspective view of the knife in FIG. 4.
Figure 6:
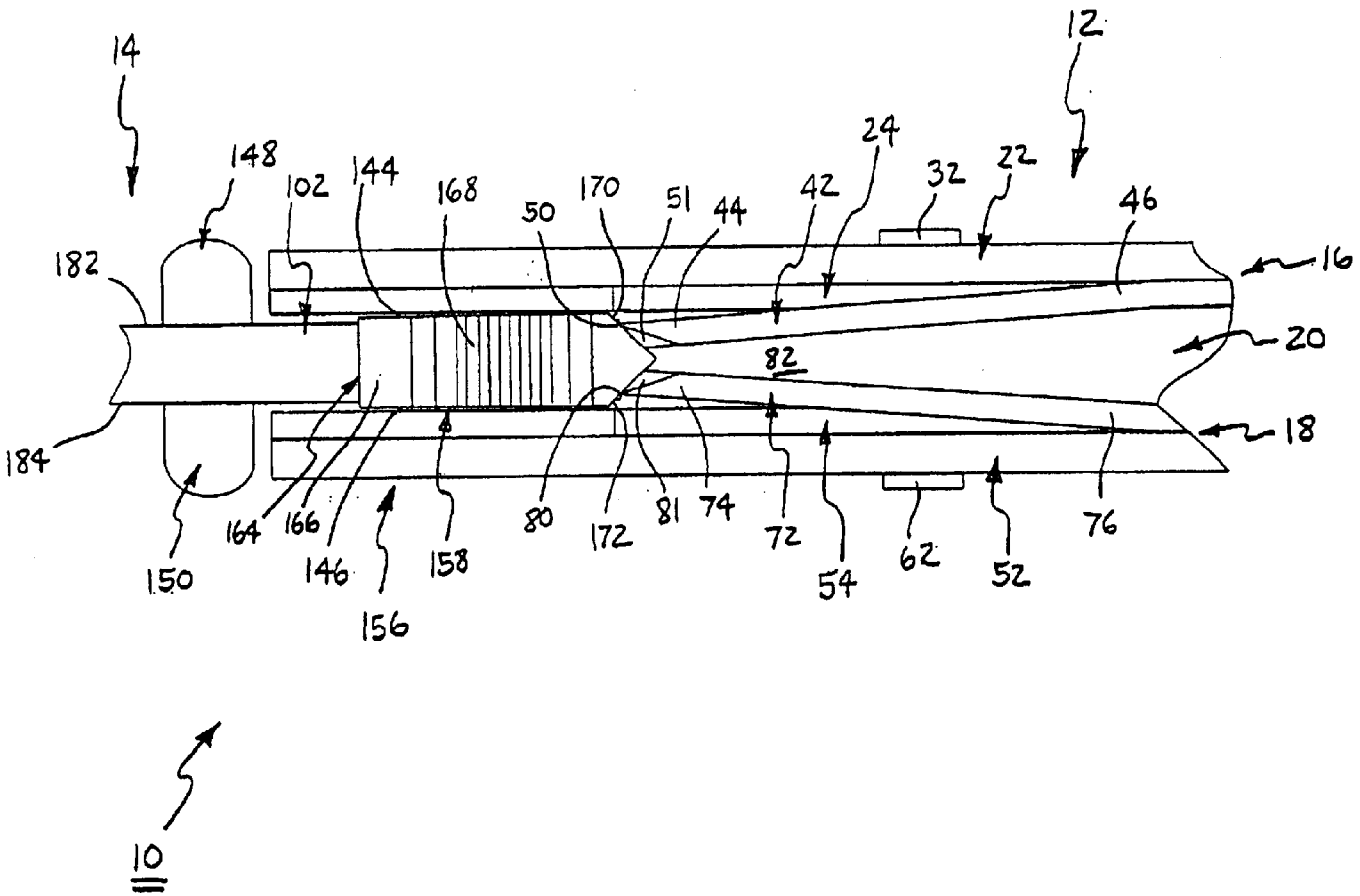
FIG. 6 is a partially fragmented, top, plan view of the knife in FIG. 1.

FIGS. 4–6 show knife 10 locked in an open position. For clarity, scale 22, liner 24, pivot rod 130, and spacer 144 are not shown in FIGS. 4 and 5. When blade 14 is in the open position, moveable arms 42, 72 extend into cavity 82 (FIG. 6) such that free ends 44, 74 are in their substantially relaxed position. As best shown in FIG. 5 and 6, when in this position, engagement surfaces 50, 80 of free ends 44, 74, contact stop surfaces 120, 118 of wedge 108, respectively. As best shown in FIG. 5, blade 14 is thereby locked in the open position and prevented from pivoting counter-clockwise (as viewed in the figures). It should be noted that further clockwise rotation of blade 14 is also prevented by engagement between abutment surface 92 of spacer 20 and abutment surface 114 of base 102. When in this open, in-use position, blade 14 is securely locked by both inwardly biased moveable arms 42, 72, thereby preventing accidental closure of blade 14 into body 12.

As is also shown in FIGS. 4 and 5, when blade 14 is in the open position, actuator 158 of release mechanism 156 is positioned away from arms 42, 72. More specifically, rod 160 is positioned within slot 116 adjacent the end of slot 116 opposite wedge 108.

Figure 7:
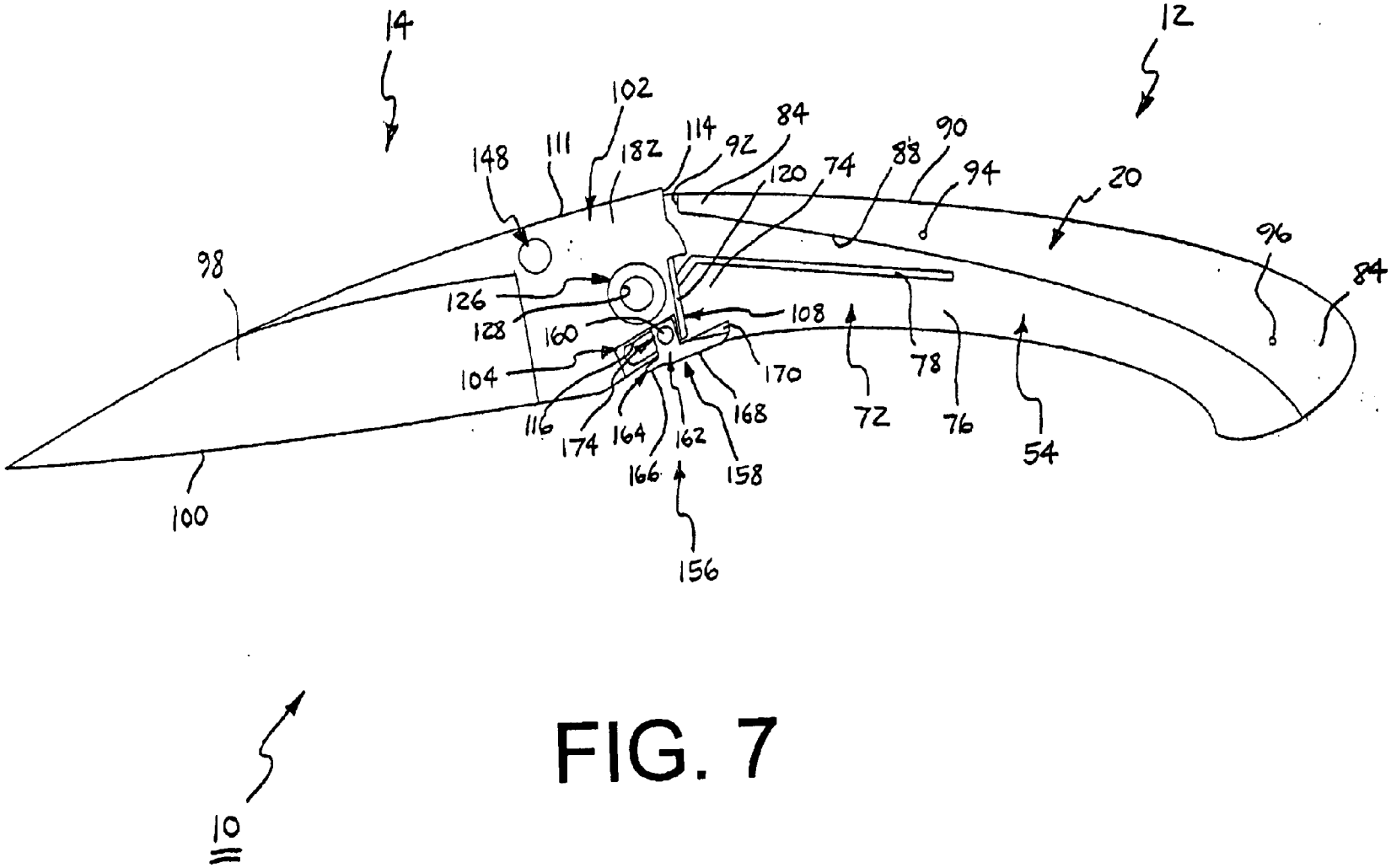
FIG. 7 is a side, elevational view similar to FIG. 4, showing the blade of the knife moved slightly out of the open position.
Figure 8:
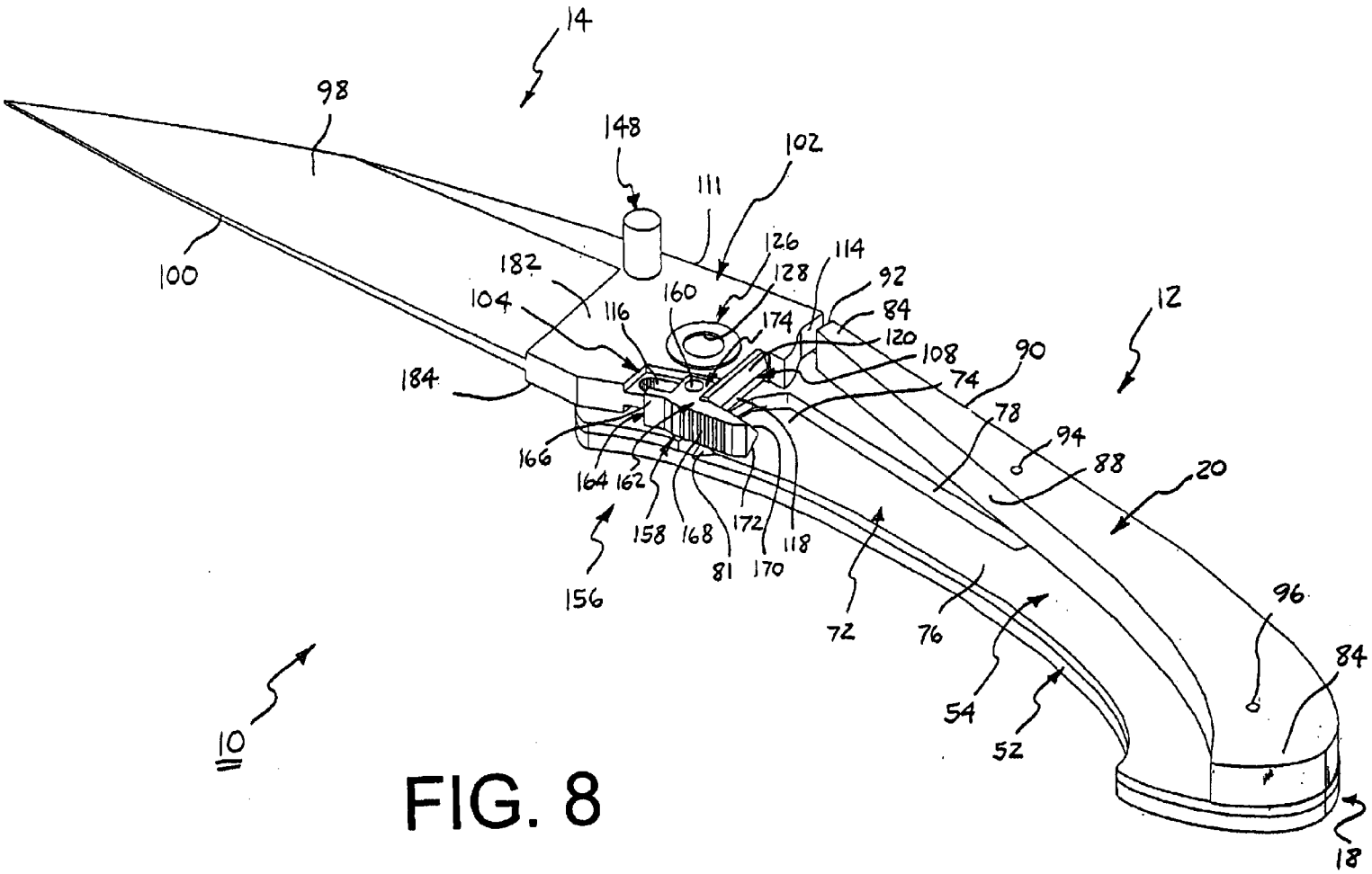
FIG. 8 is a perspective view of the knife shown in FIG. 7.
Figure 9:
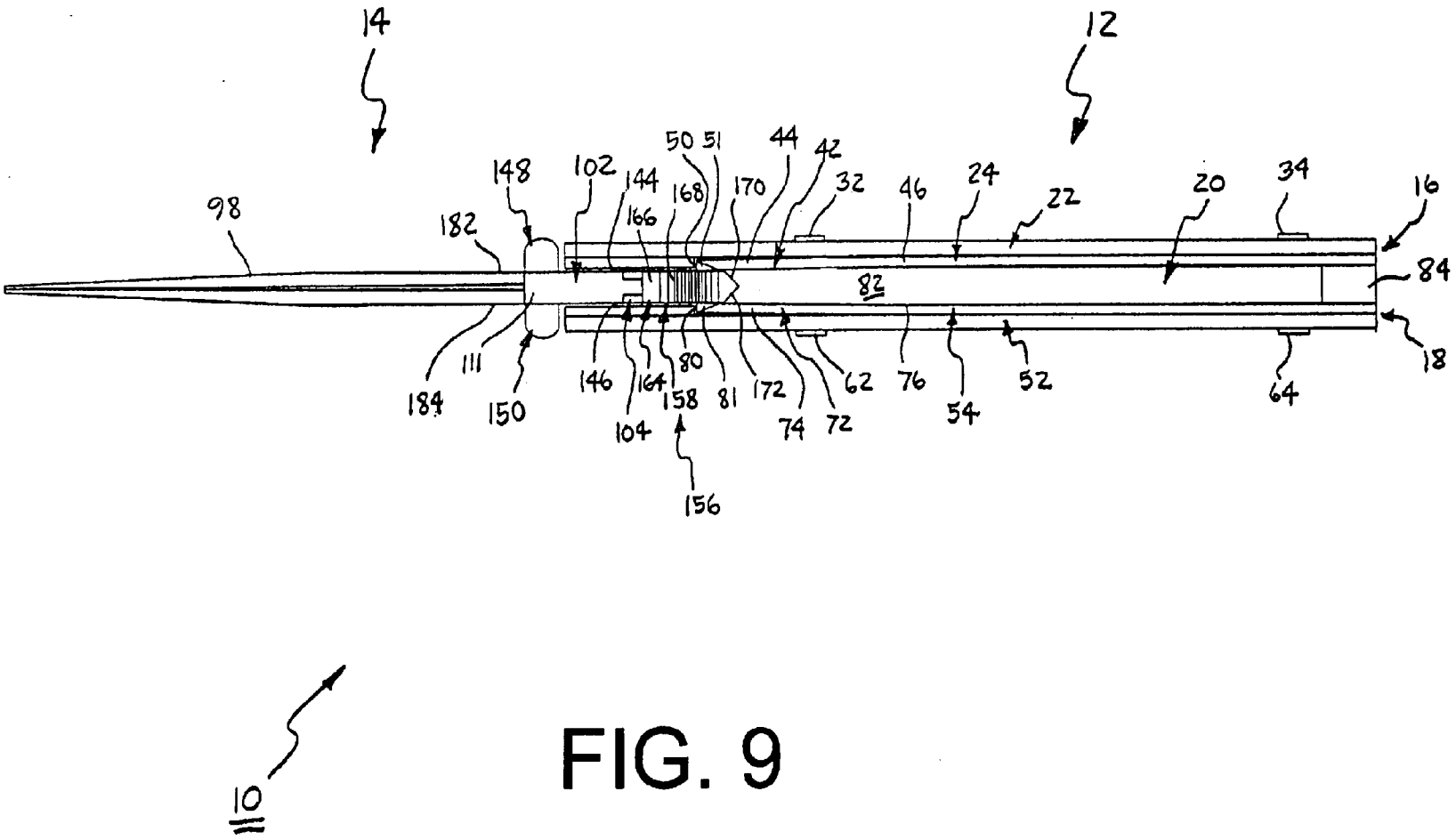
FIG. 9 is a top, plan view of the knife shown in FIG. 8 with all components shown.

Blade 14 may be moved out of the locked, open position by first moving release mechanism 156 toward arms 42, 72 as shown in FIGS. 7–9. More specifically, pressure is applied to bearing surface 168 of actuator 158 to move actuator 158 toward arms 42, 72 through the path of travel defined by slot 116. As actuator 158 is moved through its path of travel, rod. 160 slides through slot 116 toward the end of slot 116 adjacent wedge 108. As best shown in FIGS. 8 and 9, as actuator 158 is moved toward arms 42, 72, cam surfaces 170, 172 bear against cam surfaces 51, 81 of free ends 44, 74. As actuator 158 is further moved in this direction, cam surfaces 170, 172 wedge between and spread apart free ends 44, 74 against the inward biasing force of arms 42, 72. When actuator 158 reaches the end of its path of travel, free ends 44, 74 are substantially flexed out of their relaxed position by an amount sufficient to permit wedge 108 (and the remainder of base 102) to slide between arms 42, 72. As best shown in FIG. 9, when fully urged away from one another by actuator 158, free ends 44, 74 are substantially planar with liners 24, 74, respectively, and are separated by a distance that is substantially equal to the thickness of base 102 of blade 14. Since free ends 44, 74 are no longer in locking engagement with stop surfaces 120, 118, blade 14 may be pivoted counter-clockwise (as viewed in the figures) out of the open position by applying pressure to edge 111 of blade 14.

Figure 10:
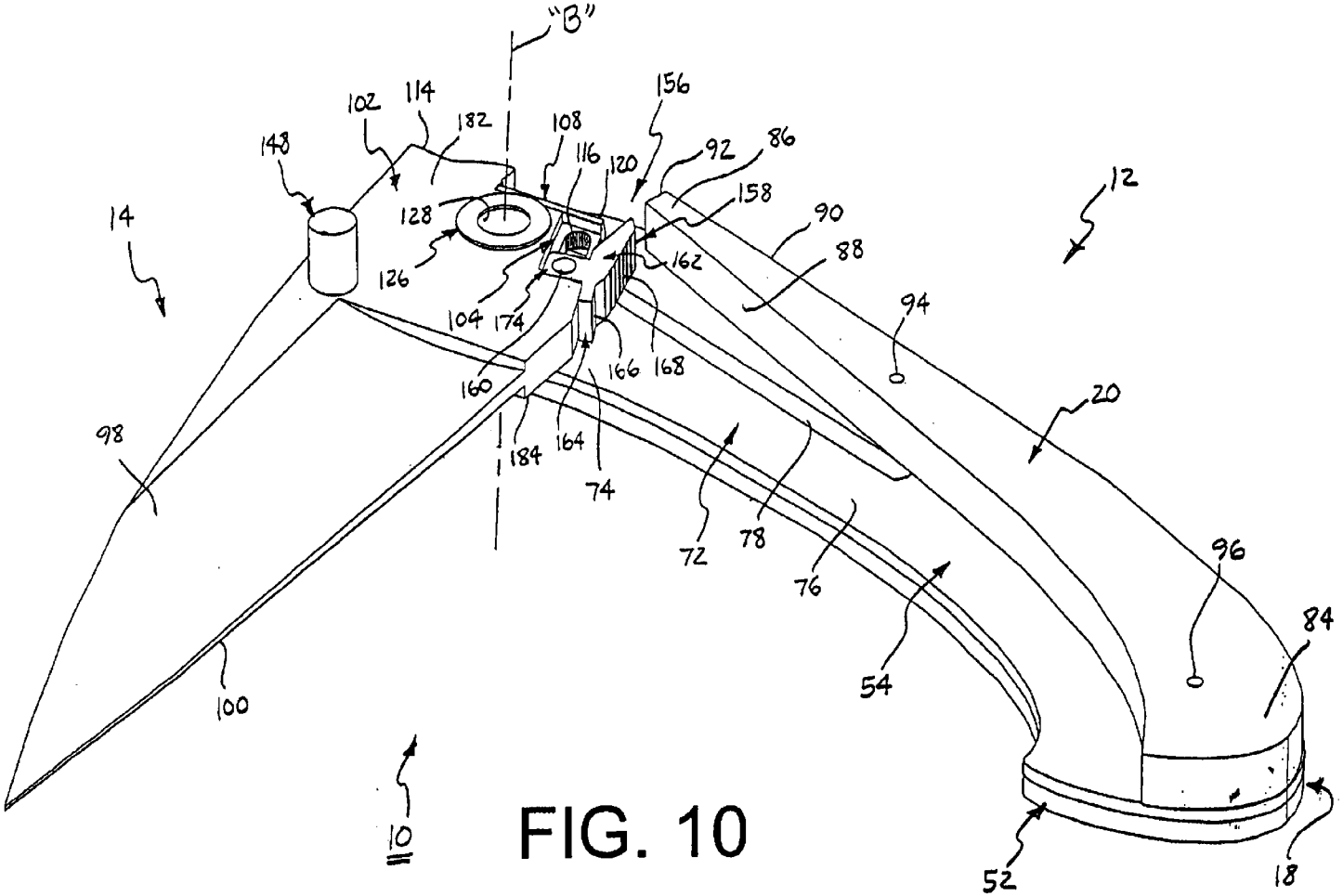
FIG. 10 is a perspective view of a knife according to the present invention shown approximately half-way between the open and the closed positions with certain components removed for clarity.

FIG. 10 shows blade 14 approximately half-way through its rotation about rotation axis "B" between the open position and the closed position. As blade 14 rotates, end 44, 74 of arms 42,72 are urged against and ride along side surfaces 182, 184, respectively, of blade base 102. Since arms 42, 72 are flexed out of their relaxed position, the biasing force generated by the resiliency of arms 42, 72 urges the arms against side surfaces 182, 184, thereby providing some resistance to the rotation of blade 14.

Figure 11:
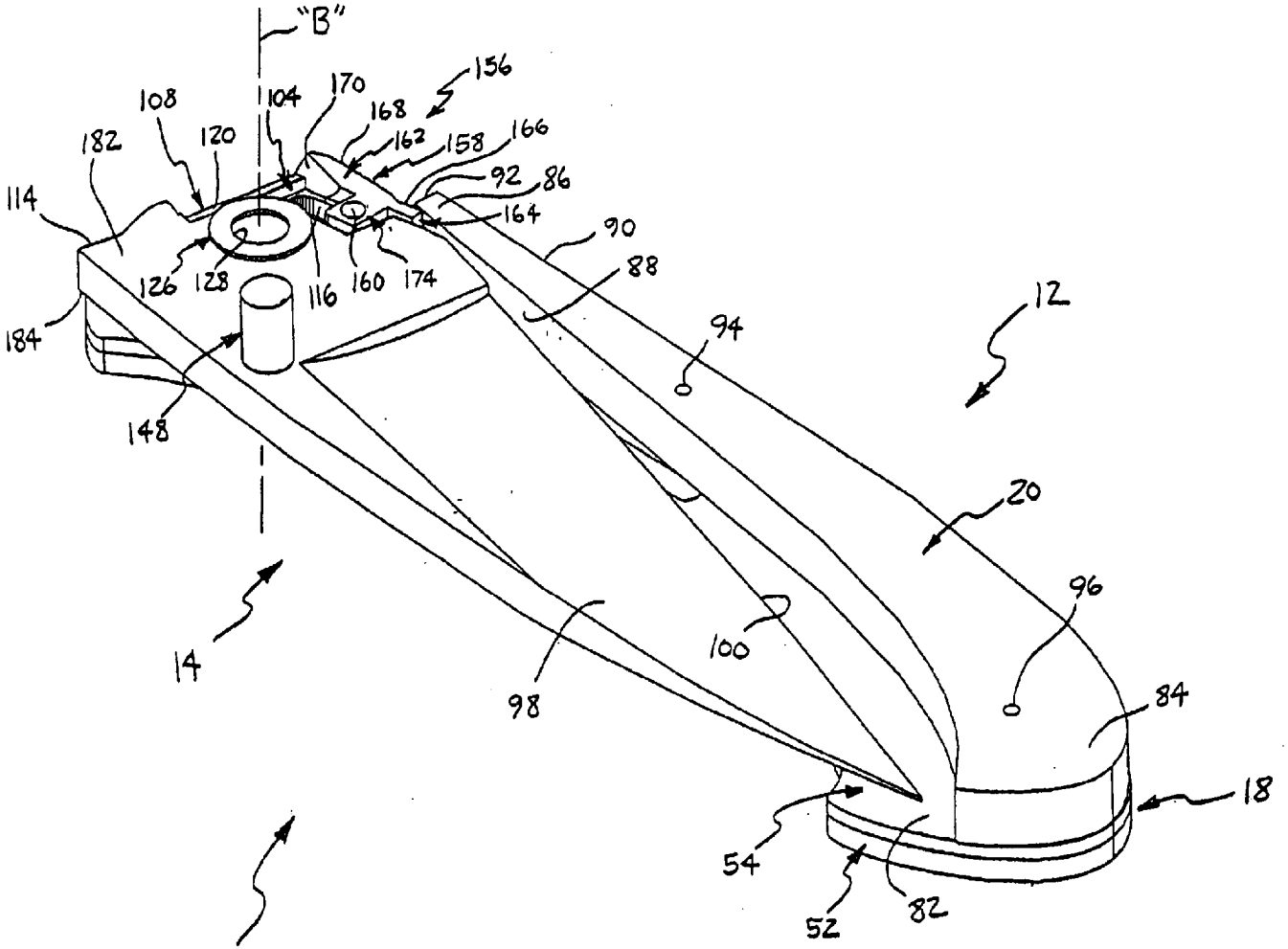
FIG. 11 is a perspective view of a knife according to the present invention in the closed position with certain components removed for clarity.
Figure 12:
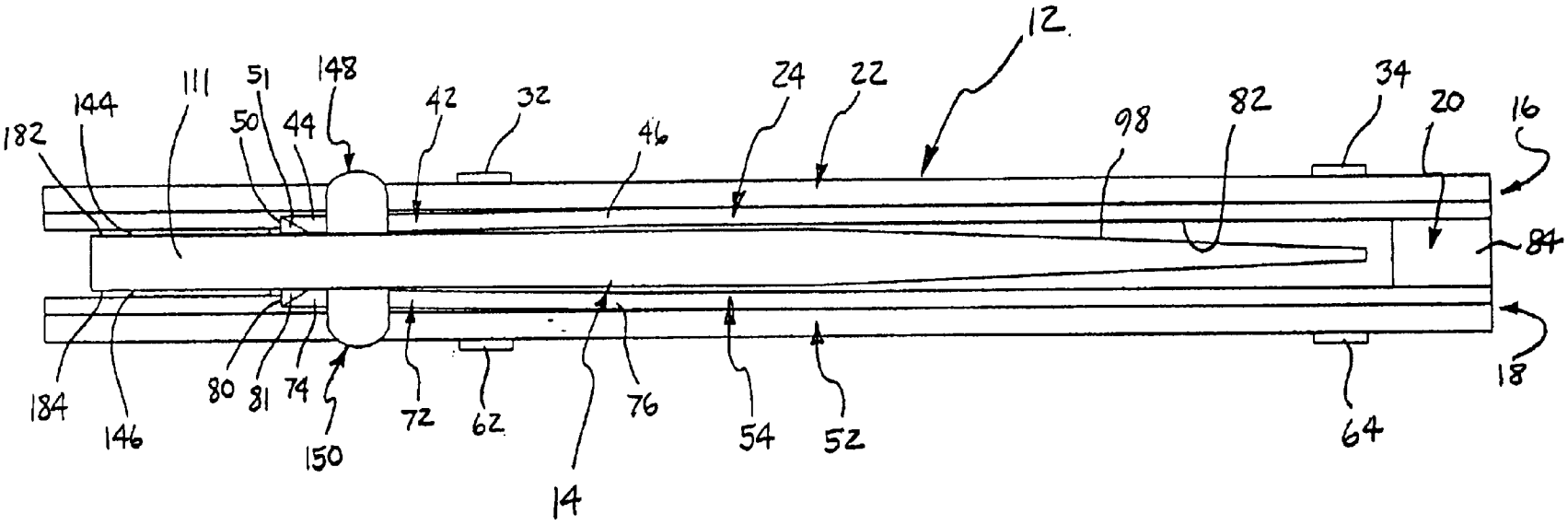
FIG. 12 is a top, plan view of the knife according to the present invention in the closed position.

FIGS. 11 and 12 show knife 10 in its closed position. As best shown in FIG. 11, a substantial portion of blade 14, including sharpened edge 100 is disposed within cavity 82. When blade 14 reaches the closed position, stop surface 166 of end tab 164 engages side 88 of spacer 20 at end 86. This engagement prevents further rotation of blade 14 about axis "B," and prevents sharpened edge 100 of blade 14 from engaging side 88 of spacer 20. As shown in FIG. 12, free ends 44, 74 of arms 42, 72 remain biased against side surfaces 182, 184, respectively. The compressive force supplied by ends 44, 74 retains blade 14 in the closed position. This compressive force, however, can be overcome by pushing against either thumb stud 148 or thumb stud 150.

While holding body 12 with the palm and fingers, of one hand, the thumb of that hand is free to urge the appropriate thumb stud 148, 150 upwardly causing rotation of blade 14 out of the closed position. In this manner, blade 14 may be rotated clockwise (as viewed in the figures) to the open position as shown in FIG. 1. When blade 14 reaches the open position, ends 44, 74 of arms 42, 72, snap inwardly toward one another to engage stop surfaces 120, 118, respectively, thereby locking blade 14 in the open position as described above.

The foregoing description of the invention is illustrative only, and is not intended to limit the scope of the invention to the precise terms set forth. Although the invention has been described in detail with reference to certain illustrative embodiments, variations and modifications exist within the scope and spirit of the invention as described and defined in the following claims.

What is claimed:

1. A knife including:

a body;

a blade pivotally connected to the body, the blade being movable between a closed position wherein the blade is positioned substantially within the body and an open position wherein the blade is positioned substantially outside the body; and a pair of movable arms disposed within the body and biased toward one another into a locking position wherein the arms lock the blade in the open position.

2. The knife of claim 1 wherein the arms move into and out of the locking position by flexing.

3. The knife of claim 1 wherein the arms are biased against the blade when the blade is in the closed position, thereby resisting movement of the blade out of the closed position.

4. The knife of claim 1 further including a release mechanism coupled to the blade, the release mechanism including a wedge for moving the arms out of the locking position, thereby permitting movement of the blade out of the open position.

5. The knife of claim 4 wherein the release mechanism is movable toward and away from the arms along a path of travel defined by the blade.

6. The knife of claim 5 wherein the path of travel is defined by a slot formed in the blade.

7. The knife of claim 1 wherein the body includes a pair of sides, one of the arms being connected to one of the sides, the other arm being connected to the other side.

8. The knife of claim 7 wherein each of the sides includes a liner, the one arm being connected to the liner of the one side, the other arm being connected to the liner of the other side.

9. The knife of claim 8 wherein the body further includes a spacer disposed between the liners to form a cavity between the liners for receiving the blade when the blade is moved to the closed position, the arms being biased into the cavity.

10. The knife of claim 7 wherein the one arm is integral with the one side and the other arm is integral with the other side.

11. The knife of claim 7 wherein the blade is pivotally connected to one end of each of the sides and includes a free end that is disposed adjacent another end of each of the sides when the blade is in the closed position.

12. The knife of claim 11 wherein the one arm has a first end that is connected to the one side and a free end that engages a stop surface of the blade, and the other arm has a first end that is connected to the other side and a free end that engages the stop surface of the blade.

13. The knife of claim 12 wherein the free end of the one arm includes an engagement surface for engaging the stop surface and the free end of the other arm includes an engagement surface for engaging the stop surface, the engagement surfaces forming a first obtuse angle when the arms are in the locking position.

14. The knife of claim 13 wherein the stop surface includes a first surface for engaging the engagement surface of the one arm and a second surface for engaging the engagement surface of the other arm, the first and second surfaces forming a second obtuse angle that is substantially equal to the first obtuse angle.

15. A knife including:

a body defining a cavity, the body including an arm extending into the cavity;

a blade connected to the body for rotation about a rotation axis between a closed position substantially within the cavity, and an opened position substantially outside the cavity wherein the arm engages the blade, thereby locking the blade in the opened position; and a release mechanism coupled to the blade for movement toward and away from the arm, the release mechanism having a cam surface for urging the arm out of engagement with the blade when the blade is in the opened position and the release mechanism is moved toward the arm;

wherein the blade includes a slot adjacent the rotation axis, the release mechanism being movable along the slot.

16. The knife of claim 15 wherein the release mechanism further includes a rod extending through the slot to couple the release mechanism to the blade.

17. A knife including:

a body defining a cavity, the body including an arm extending into the cavity;

a blade connected to the body for rotation about a rotation axis between a closed position substantially within the cavity, and an opened position substantially outside the cavity wherein the arm engages the blade, thereby locking the blade in the opened position; and a release mechanism coupled to the blade for movement toward and away from the arm, the release mechanism having a cam surface for urging the arm out of engagement with the blade when the blade is in the opened position and the release mechanism is moved toward the arm;

wherein the release mechanism includes a pair of substantially parallel tabs, the blade including a recessed portion defining a path of travel of the release mechanism toward and away from the arm, the recessed portion being disposed between the tabs.

18. The knife of claim 17 wherein the recessed portion includes a slot for cooperating with the tabs to guide the release mechanism through the path of travel.

19. The knife of claim 18 wherein the release mechanism further includes a rod extending through the slot and connected to the pair of tabs to coupled the release mechanism to the blade.

20. A knife including:

a body defining a cavity, the body including an arm extending into the cavity;

a blade connected to the body for rotation about a rotation axis between a closed position substantially within the cavity, and an opened position substantially outside the cavity wherein the arm engages the blade, thereby locking the blade in the opened position; and a release mechanism coupled to the blade for movement toward and away from the arm, the release mechanism having a cam surface for urging the arm out of engagement with the blade when the blade is in the opened position and the release mechanism is moved toward the arm;

wherein the body includes a pair of arms extending into the cavity for locking the blade in the opened position.

21. The knife of claim 20 wherein the release mechanism includes a pair of cam surfaces for urging the pair of arms out of engagement with the blade when the blade is in the opened position and the release mechanism is moved toward the arms.

22. The knife of claim 20 wherein the pair of arms are biased against the blade when the blade is in the closed position, thereby resisting movement of the blade out of the closed position.

23. A knife including:

a body having a cavity and a pair of opposed arms, each of the arms having a free end extending into the cavity; and a blade connected to the body for rotation between a closed position wherein the blade is a blade connected to the body for rotation between a closed position wherein the blade is disposed substantially within the cavity and an open position wherein the blade is disposed substantially outside the cavity, the arms engaging side surfaces of the blade when the blade is in the closed position to resist movement of the blade out of the closed position, and engaging a stop surface of the blade when the blade is in the open position, thereby locking the blade in the open position, the blade including a release mechanism for moving the arms out of locking engagement with the blade when the blade is in the open position to permit movement of the blade out of the open position.

* * * * *